US010495302B2

(12) United States Patent
Huang et al.

(10) Patent No.: US 10,495,302 B2
(45) Date of Patent: Dec. 3, 2019

(54) COMBUSTOR

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW); Wei-Long Chen, Taichung (TW); Kuan-Chou Lin, Taichung (TW); Tang-Yuan Luo, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 372 days.

(21) Appl. No.: 15/411,326

(22) Filed: Jan. 20, 2017

(65) Prior Publication Data

US 2018/0087772 A1 Mar. 29, 2018

(30) Foreign Application Priority Data

Sep. 26, 2016 (TW) ..... 105131036 A

(51) Int. Cl.
*F23D 14/14* (2006.01)
*F23D 14/58* (2006.01)

(52) U.S. Cl.
CPC ..... *F23D 14/14* (2013.01); *F23D 14/583* (2013.01); *F23D 14/586* (2013.01)

(58) Field of Classification Search
CPC ..... F23D 14/14; F23D 14/105; F23D 14/58; F23D 2213/00; F23D 14/26;
(Continued)

(56) References Cited

U.S. PATENT DOCUMENTS 5,661,905 A * 9/1997 Nakaura ..... F23D 14/045 29/428
6,062,849 A 5/2000 Polidoro

FOREIGN PATENT DOCUMENTS

CN 201539975 U 8/2010
CN 102080823 A 6/2011
(Continued)

OTHER PUBLICATIONS

Chinese Intellectual Property Office, Office Action, dated Dec. 12, 2018, 7 pages.

*Primary Examiner* — Alfred Basichas
(74) *Attorney, Agent, or Firm* — Muncy, Geissler, Olds & Lowe, P.C.

(57) ABSTRACT

A combustor is provided, including a pipe and a burner tray. The pipe is transverse U-shaped, including a first pipe section and a second pipe section. The first pipe section has an inlet, and the second pipe section has an outlet extending along an axial direction thereof. The second pipe section has at least one reduced section, wherein a smallest sectional area in the reduced section is smaller than sectional areas on both sides of the reduced section. The burner tray is connected to the second pipe section, provided over the outlet, and has a plurality of flame holes which communicate with the outlet. Whereby, with the reduced section, the flow including gas could be evenly delivered to the burner tray. As a result, after the gas exhausted through the flame holes is ignited, the combustion range would be evener, which enhances the combustion efficiency.

17 Claims, 13 Drawing Sheets

(58) Field of Classification Search
CPC ..... F23D 14/583; F23D 14/586; F23D 2900/14001; F23D 2203/1026
See application file for complete search history.

(56) References Cited

FOREIGN PATENT DOCUMENTS

| | | | |
|---|---|---|---|
| CN | 102537962 | A | 7/2012 |
| CN | 202647761 | U | 1/2013 |
| CN | 102997240 | A | 3/2013 |
| JP | 2007285536 | A | 11/2007 |
| JP | 2013178006 | A | 9/2013 |
| TW | M391079 | U | 10/2010 |
| TW | M529123 | U | 9/2016 |
| WO | 9815781 | A1 | 4/1998 |

* cited by examiner

COMBUSTOR

BACKGROUND OF THE INVENTION

1. Technical Field

The present invention relates generally to a heating apparatus, and more particularly to a combustor which could facilitate the mixing of gas and air, so as to make burning more evenly.

2. Description of Related Art

As shown in FIG. 1, a conventional combustor 1 includes a main body 2 and a burner tray 3. The main body 2 is composed of two symmetrical plates, and each of the plates is punched into a predetermined shape. A U-shaped pipe 2*a* is transversely formed within the main body 2, wherein the pipe 2*a* has an inlet 2*b* at an end thereof for letting gas and air in. The burner tray 3 is elongated and provided over the main body 2. The burner tray 3 has a plurality of flame holes 3*a* at the top which are aligned along the long axis of the burner tray 3, and communicate with the pipe 2*a*. When mixed gas and air enter the pipe 2*a*, and then are exhausted through the flame holes 3*a* of the burner tray 3, the gas could be ignited to form flames.

However, the conventional combustor 1 fails to burn gas evenly due to the shape of the pipe 2*a*. In more details, the pipe 2*a* of the main body 2 has a bending section. When the flow of gas and air entering through the inlet 2*b* arrives at the bending section of the pipe 2*a*, most of the flow would turn to the left after bumping into the bending section. Moreover, because the diameter of the pipe 2*a* gradually reduces from the right to the left after the bending section, after passing through the bending section, most of the flow would flow along the wall of the pipe 2*a* to be exhausted through the flame holes 3*a* on the left half of the burner tray 3. As a result, the exhausted flow from the flame holes 3*a* of the burner tray 3 would be gradually decreased from the left to the right.

FIG. 2 shows a diagram of mass flow corresponding to the positions of the flame holes 3*a* of the combustor 1. The flame holes 3*a* are numbered in the order of #01 to #44 from the left to the right. It could be clearly seen in the diagram that the mass flow corresponding to the flame holes 3*a* shows a decreasing trend from the left to the right. In other words, the flame at the flame hole 3*a* with a lower mass flow (e.g., the flame hole #34) is weaker than the flame at the flame hole 3*a* with a higher mass flow (e.g., the flame hole #04). Therefore, the flame generated by the combustor 1 would become weaker and weaker from the left to the right, which results in an uneven combustion range and a poor heating efficiency.

BRIEF SUMMARY OF THE INVENTION

In view of the above, the primary objective of the present invention is to provide a combustor which can exhaust an even flow from the flame holes of the burner tray.

The present invention provides a combustor including a pipe and a burner tray. The pipe has a first pipe section and a second pipe section, wherein the first pipe section extends in a predetermined direction. The first pipe section has an inlet at an end thereof, and the second pipe section has a first end and a second end, wherein the first end is connected to another end of the first pipe section. The second pipe section is bent in a direction away from the another end of the first pipe section, and is provided over the first pipe section. The second pipe section has an outlet extending along an axial direction thereof, and a sectional area of the second pipe section is reduced from the first end to the second end. The second pipe section has at least one reduced section, wherein a smallest sectional area in the at least one reduced section is smaller than sectional areas on both sides of the reduced section. The burner tray is connected to the second pipe section, wherein the burner tray is provided over the outlet, and has a plurality of flame holes which communicate with the outlet.

Whereby, with the reduced section provided in the second pipe section of the combustor, the flow including gas could be evenly delivered to the burner tray. As a result, after the gas exhausted through the flame holes is ignited, the combustion range would be evener, which enhances the combustion efficiency.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
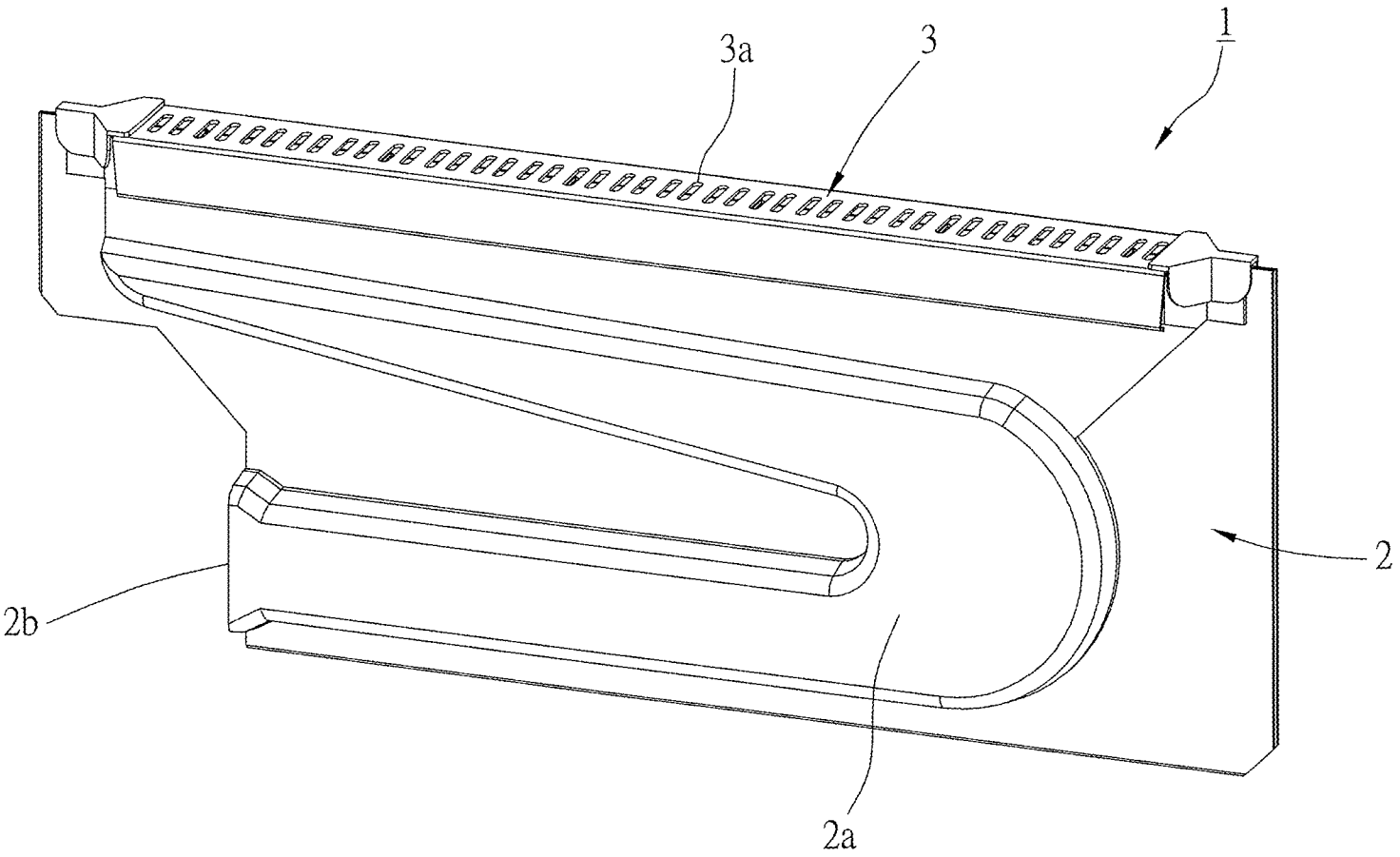
FIG. 1 (PRIOR ART)
FIG. 1 is a schematic diagram of the conventional combustor.
Figure 2:
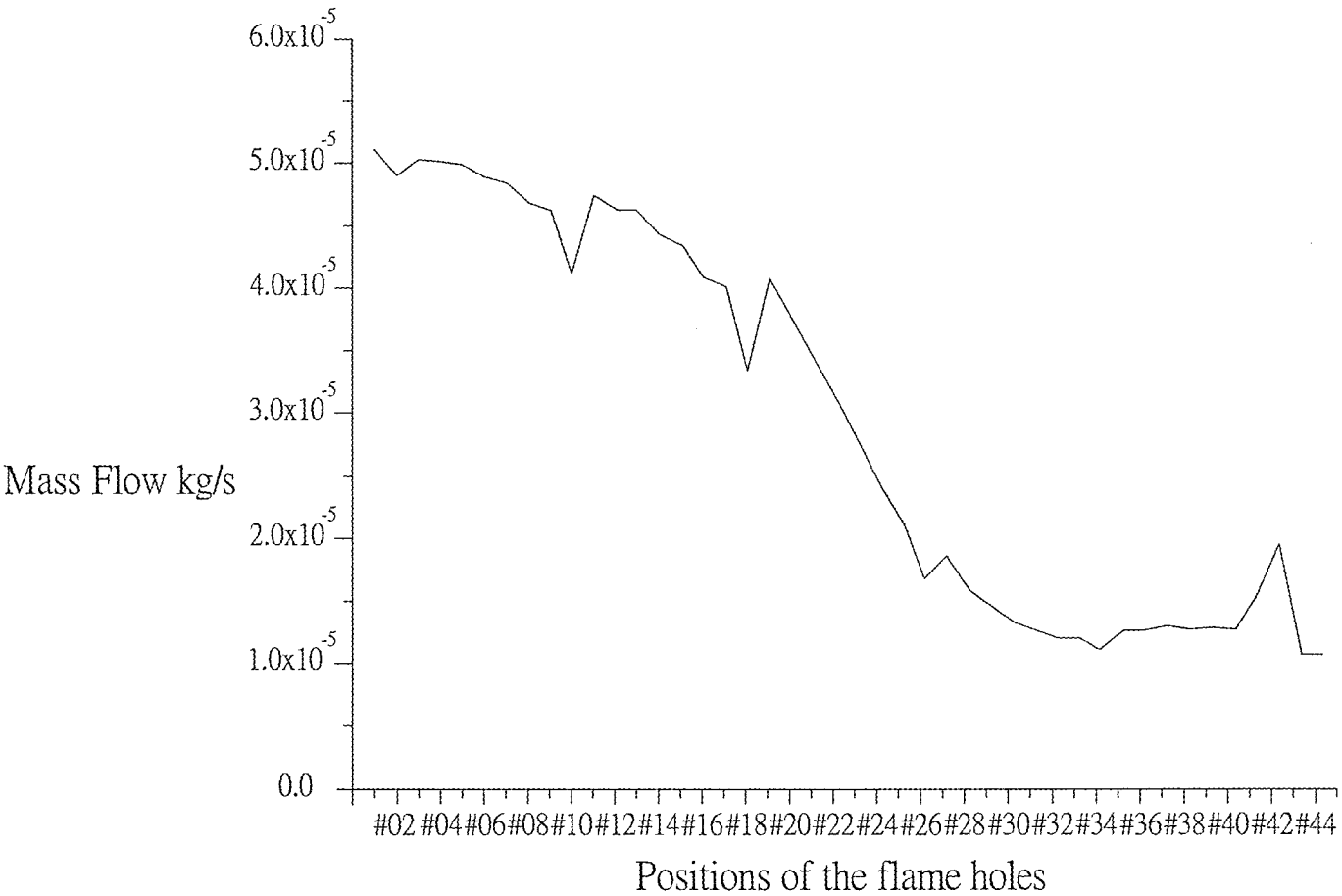
FIG. 2 (PRIOR ART)
FIG. 2 is a diagram of mass flow corresponding to the positions of the flame holes of the conventional combustor in FIG. 1.
Figure 3:
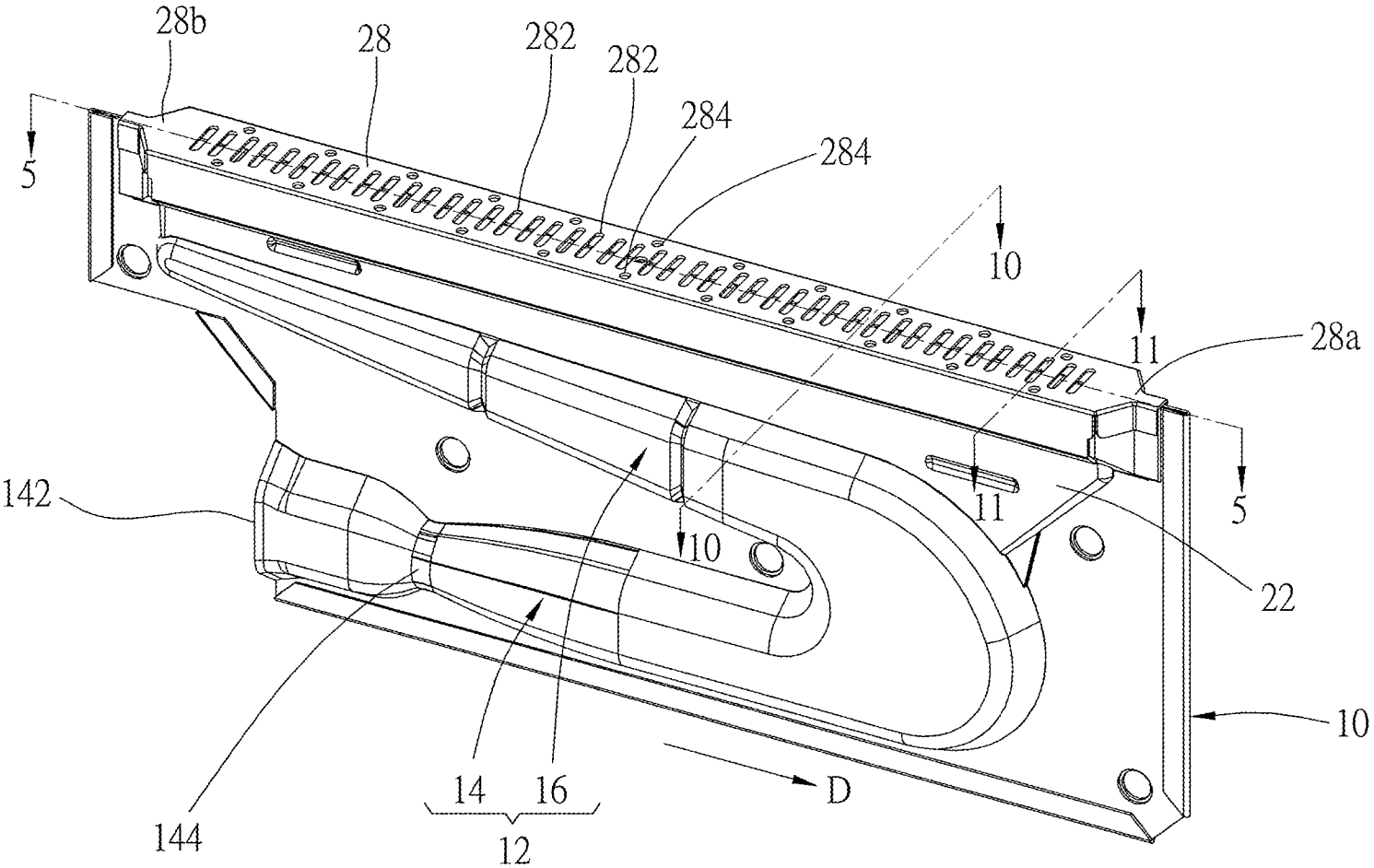
FIG. 3 is a perspective view of a first embodiment of the present invention.

As shown in FIG. 3 to FIG. 11, the combustor, the first embodiment of the present invention, includes a main body 10, a hole plate 28 and a splitting member 30.

The main body 10 consists of two symmetrical plates 102 formed by stamping into predetermined shapes, and has a pipe 12, two side plates 22, two inclined plates 24, and two vertical plates 26. The pipe 12 is transverse U-shaped, including a first pipe section 14 and a second pipe section 16. The first pipe section 14 extends along a predetermined direction D, and has an inlet 142 at an end thereof. The first pipe section 14 has a constricted section 144 between two ends thereof, wherein the inner diameter of the constricted section 144 is smaller than that of the other parts of the first pipe section 14. The sectional area in the constricted section 144 tapers off and then gradually increases along the predetermined direction D.

The second pipe section 16 has a first end 162 and a second end 164, wherein the first end 162 is connected to another end of the first pipe section 14, while the second pipe section 16 is bent in a direction away from the another end of the first pipe section 14, and is provided over the first pipe section 14. The second pipe section 16 inclines upward gradually after where the second pipe section 16 is bent, and the sectional area of the second pipe section 16 is reduced from the first end 162 to the second end 164. The second pipe section 16 has an outlet 166 on the top thereof, and extending along an axial direction thereof. In this embodiment, the outlet 166 is elongated, and has a starting end 166*a* and a terminal end 166*b*, wherein the starting end 166*a* is located at where the second pipe section 16 is bent, near the first end 162 of the second pipe section 16, while the terminal end 166*b* is near the second end 164 of the second pipe section 16.

The second pipe section 16 has two opposite inner walls 168 and 168' in the predetermined direction D at where the second pipe section 16 is bent, wherein one of the inner walls 168 near the inlet 142 has a turning point 168*a*. The second pipe section 16 has at least one reduced section between the turning point 168*a* and the second end 164, wherein the reduced section is formed by stamping, and the smallest sectional area in the reduced section is smaller than sectional areas on both sides of the reduced section. In this embodiment, the at least one reduced section includes two reduced sections, including a first reduced section 16*a* and a second reduced section 16*b*. The first reduced section 16*a* is located between and connects a first segment 16*c* and a second segment 16*d*, while the second reduced section 16*b* is located between and connects the second segment 16*d* and a third segment 166*e*.

Figure 5:
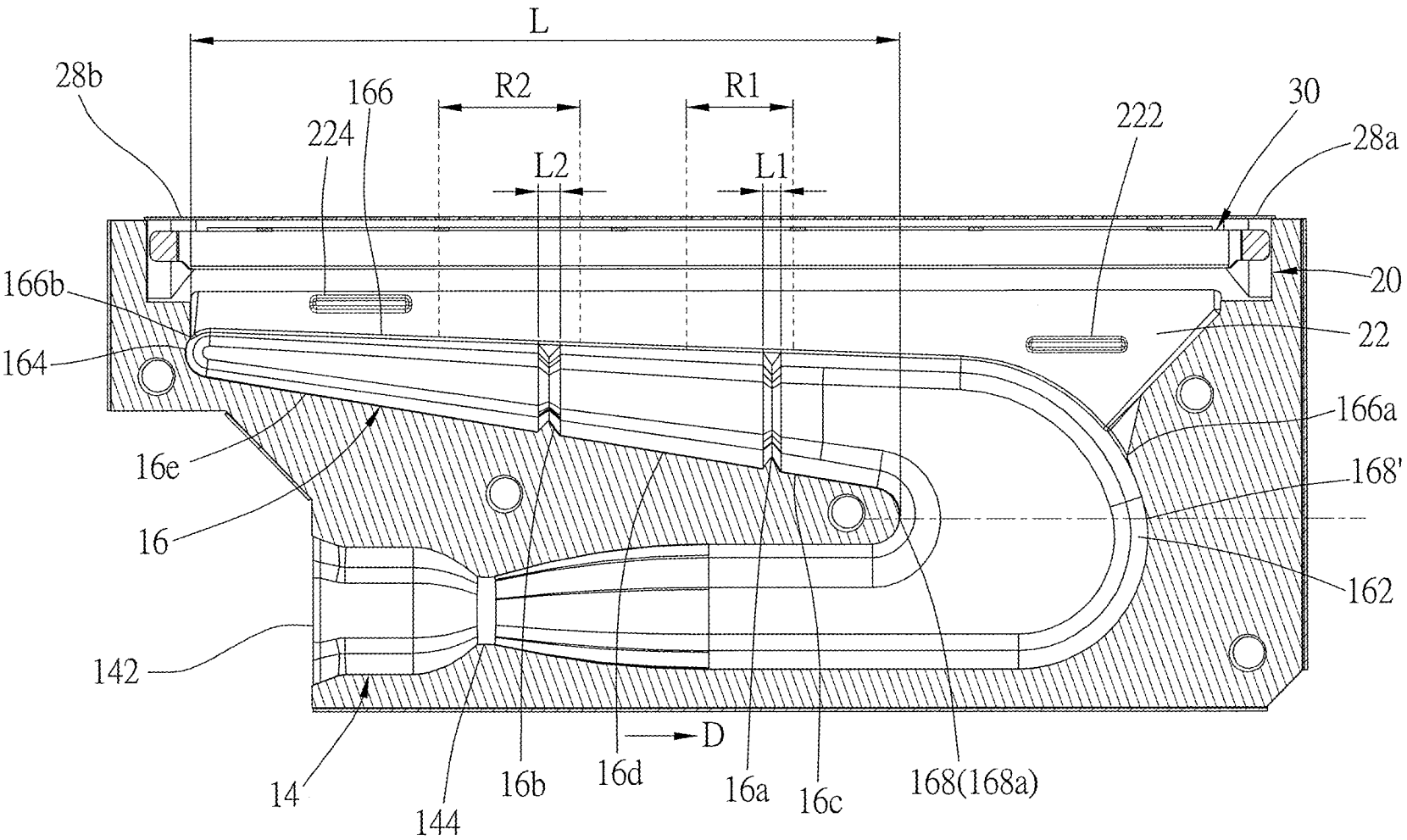
FIG. 5 is a sectional view along the 5-5 line in FIG. 3.
Figure 6:
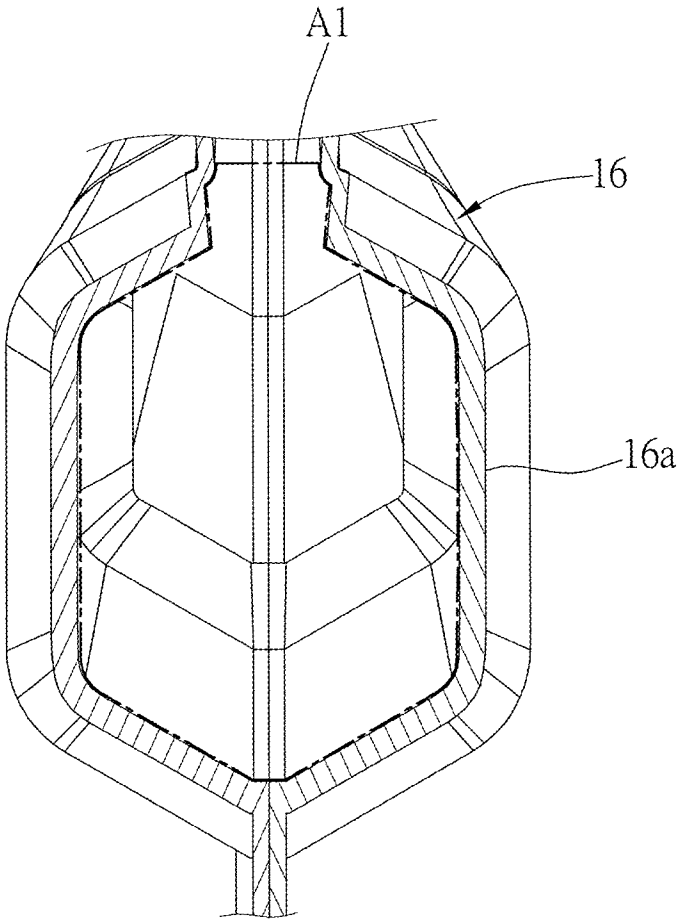
FIG. 6 is a sectional view the first embodiment, showing the smallest sectional area of the first reduced section.
Figure 7:
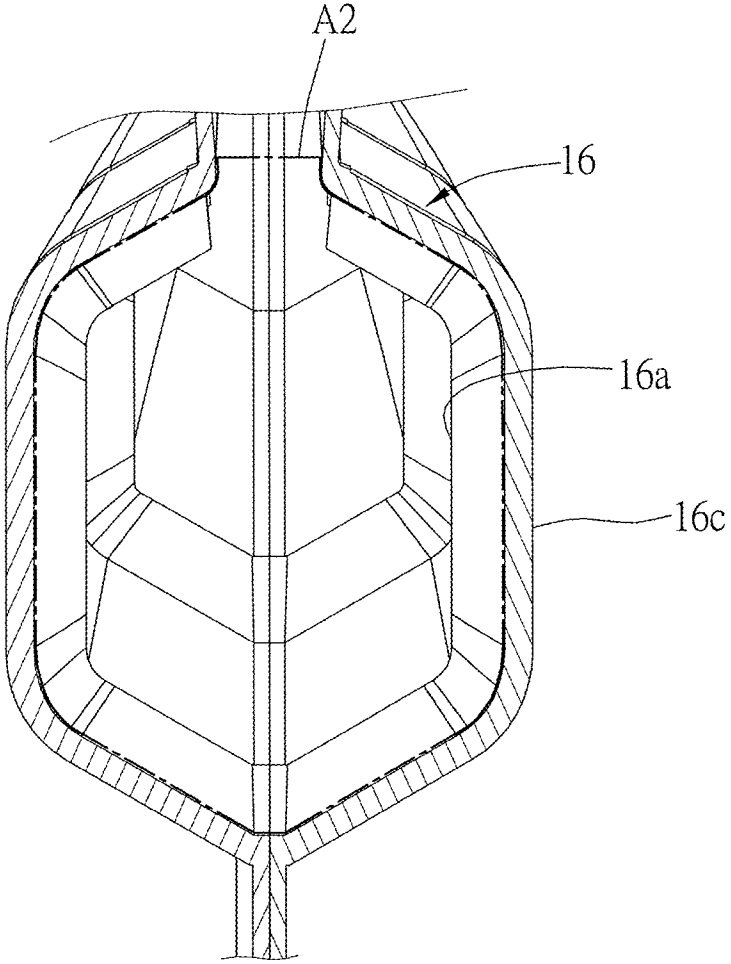
FIG. 7 is a sectional view the first embodiment, showing the sectional area of the juncture of the first reduced section and the first segment.

As shown in FIG. 5, a distance between the turning point 168*a* and the terminal end 166*b* in the predetermined direction D is defined as a predetermined distance L. The first reduced section 16*a* is provided within a first range R1 between the turning point 168*a* and the terminal end 166*b* in the predetermined direction D, wherein the first range R1 is between 15% and 30% of the predetermined distance L from the turning point 168*a*. As shown in FIGS. 6 and 7, a ratio of the smallest sectional area A1 in the first reduced section 16*a* to a sectional area A2 of a juncture of the first reduced section 16*a* and the first segment 16*c* is defined as a first ratio, which is between 50% and 65%; in this embodiment, the first ratio is approximately 62%. The length L1 of the first reduced section 16*a* in the predetermined direction D is 2% to 10% of the predetermined distance L, which is 2.4% in this embodiment.

Figure 8:
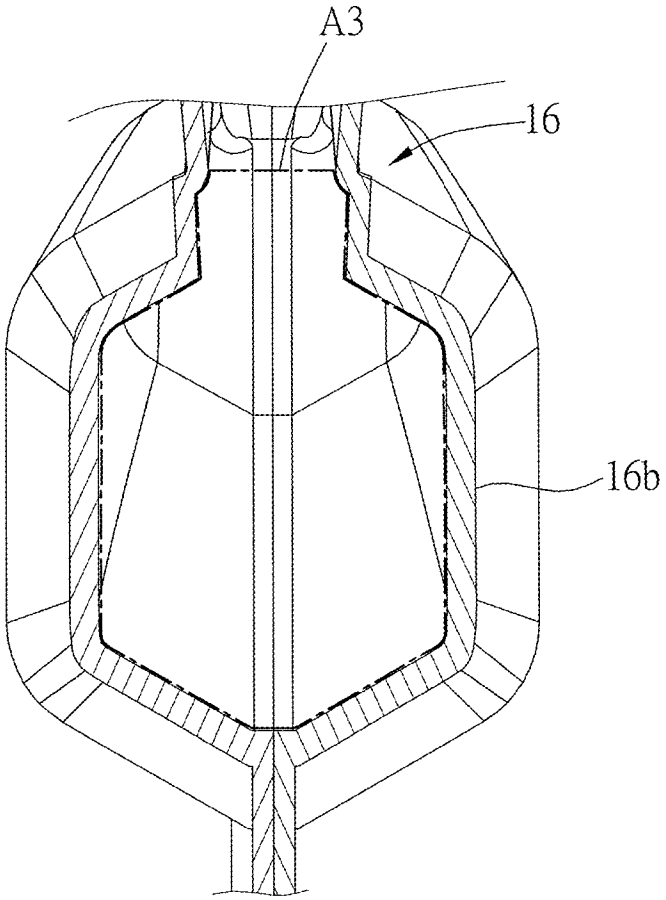
FIG. 8 is a sectional view the first embodiment, showing the smallest sectional area of the second reduced section.
Figure 9:
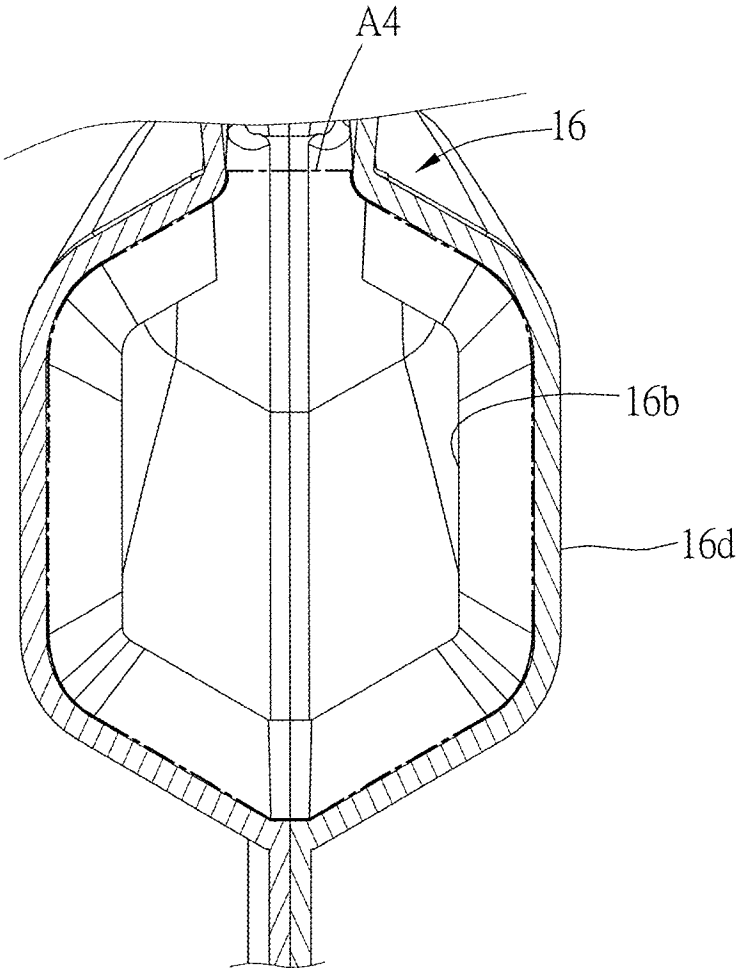
FIG. 9 is a sectional view the first embodiment, showing the sectional area of the juncture of the second reduced section and the second segment.
Figure 10:
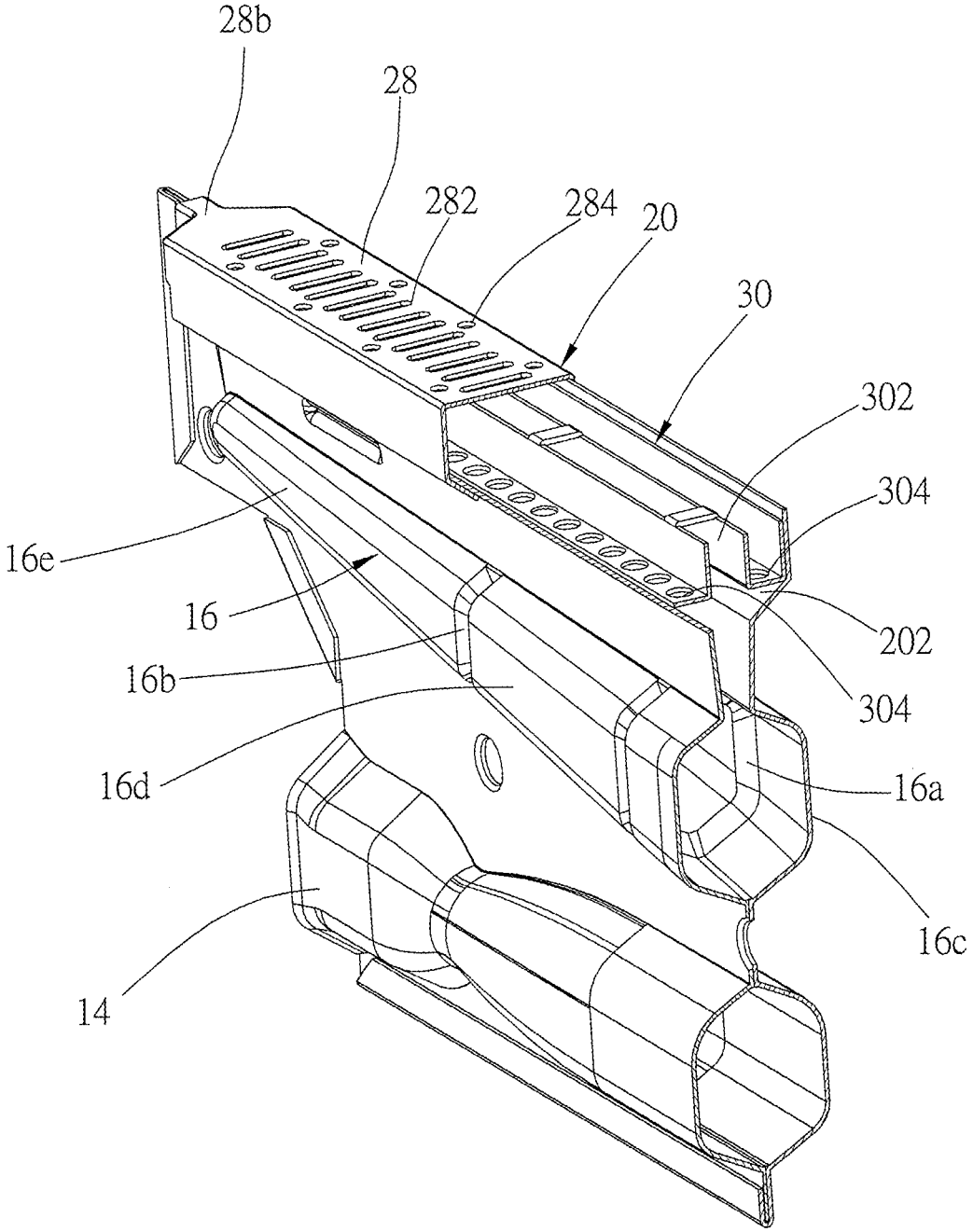
FIG. 10 is a sectional view along the 10-10 line in FIG. 3.

As shown in FIG. 5, the second reduced section 16*b* is provided within a second range R2 between the turning point 168*a* and the terminal end 166*b* in the predetermined direction D; the second range R2 is between 45% and 65% of the predetermined distance L from the turning point 168*a*. As shown in FIGS. 8 and 9, a ratio of the smallest sectional area A3 in the second reduced section 16*b* to the sectional area A4 of a juncture of the second reduced section 16*b* and the second segment 16*d* is defined as a second ratio, which is between 50% and 65%. In this embodiment, the second ratio is approximately 55%, and is less than the first ratio, which means the degree of reduction of the second reduced section 16*b* is greater than that of the first reduced section 16*a*. Practically, the second ratio could be equal to or greater than the first ratio. The length L2 of the second reduced section 16*b* in the predetermined direction D is 2% to 10% of the predetermined distance, which is 3.2% in this embodiment.

Figure 4:
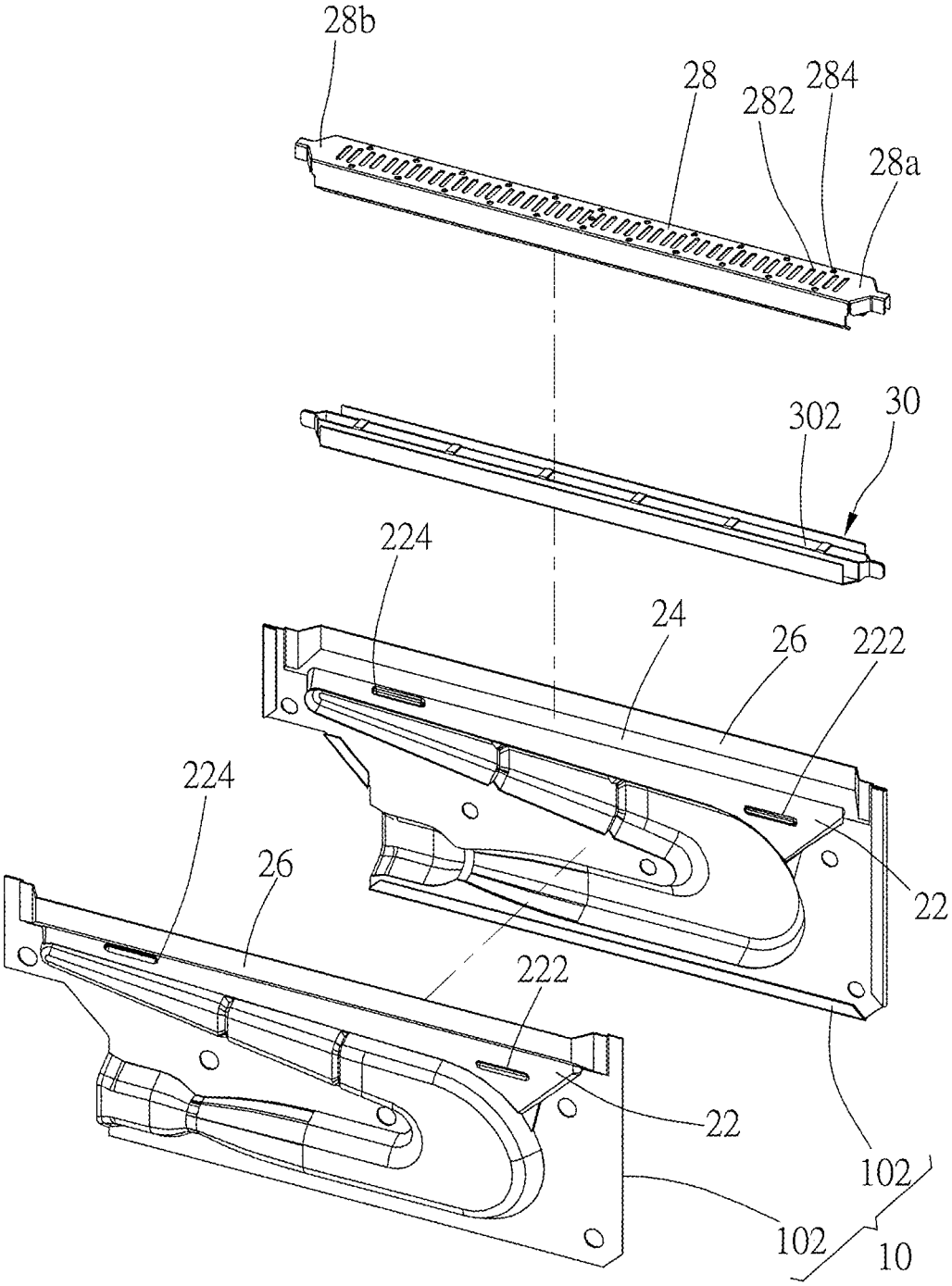
FIG. 4 is a exploded view of FIG. 3.
Figure 11:
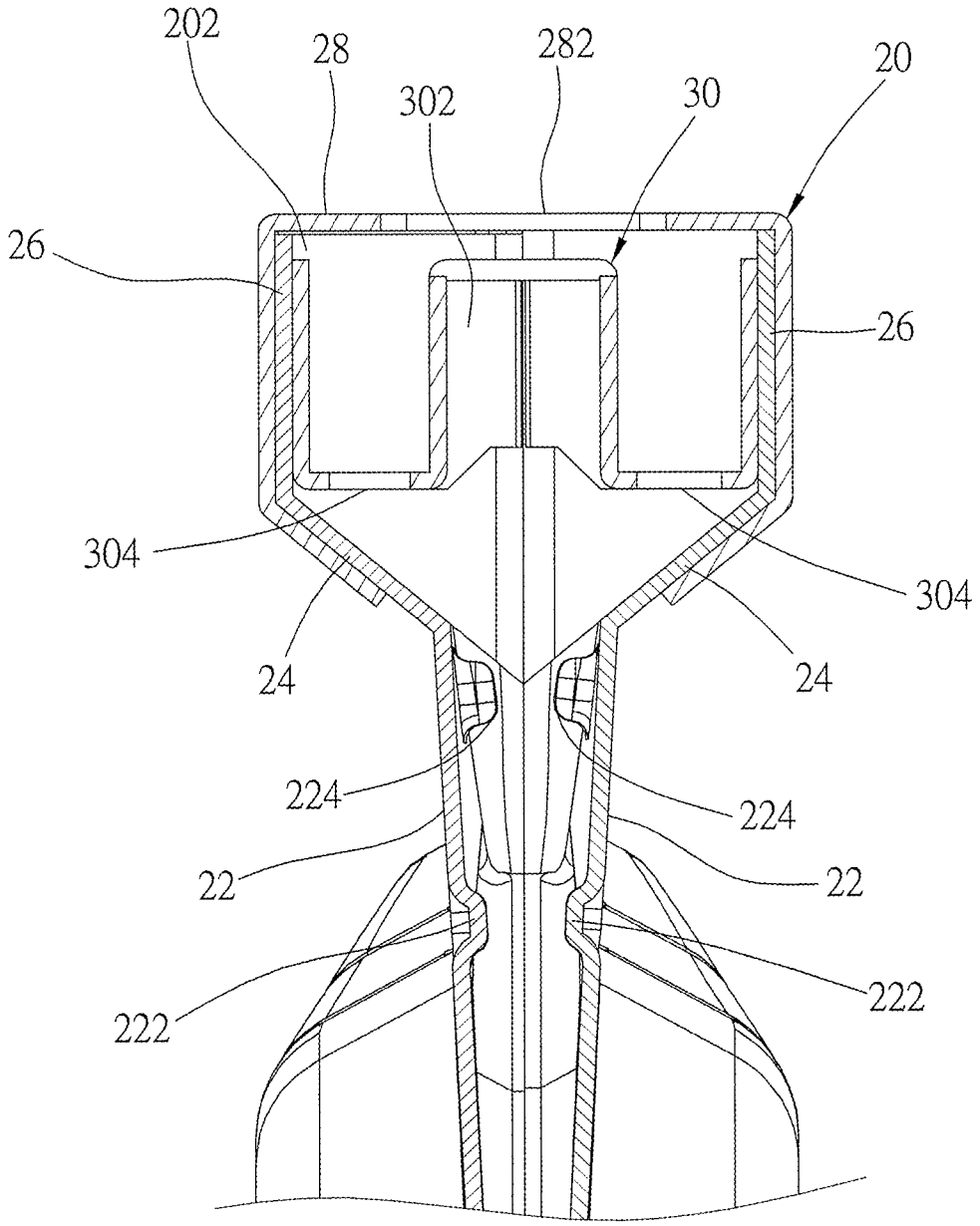
FIG. 11 is a sectional view along the 11-11 line in FIG. 3.

As shown in FIG. 11, the two side plates 22, the two inclined plates 24, the two vertical plates 26, and the hole plate 28 constitute an elongated burner tray 20. The two side plates 22 are connected to a periphery of the outlet 166 of the second pipe section 16, and are provided between the outlet 166 and the hole plate 28. The distance between two opposite walls formed by the two side plates 22 increases in a direction from the outlet 166 to the hole plate 28. As shown in FIG. 4 and FIG. 11, the two opposite walls of the two side plates 22 have two elongated protrusions 222, 224 respectively by stamping, wherein a long axial direction of each of the protrusions 222, 224 extends along the predetermined direction D. In addition, the pair of protrusions 222 is provided over the starting end 166*a*, while the other pair of protrusions 224 is provided over a region between the second reduced section 16*b* and the terminal end 166*b* of the outlet 166.

The two inclined plates 24 are respectively connected to the tops of the two side plates 22. The distance between the two inclined plates 24 gradually increases from the bottom to the top, and the degree of increasing thereof is greater than the that of the two side plates 22. The two vertical plates 26 are respectively connected to the tops of the two inclined plates.

The hole plate 28 is connected to the two vertical plates 26, and has a first end 28*a* and a second end 28*b*. The first end 28*a* is near the starting end 166*a* of the outlet 166, while the second end 28*b* is near the terminal end 166*b* of the outlet 166. Additionally, the hole plate 28 has a plurality of flame holes which communicate with the outlet 166 of the second pipe section 16, wherein the flame holes includes a plurality of first flame holes 282 and a plurality of second flame holes 284. The first flame holes 282 are aligned along the long axial direction of the burner tray 20. The second flame holes 284 are distributed to two sides of the first flame holes 282 in the short axial direction of the burner tray 20, wherein the second flame holes 284 on each of the two sides of first flame holes 282 are aligned along the long axial direction of the burner tray 20. In this embodiment, the second flame holes 284 are aligned in the long axial direction of the burner tray 20 in pairs, and at least one of the first flame holes 282 is provided between each two adjacent pairs of the second flame holes 284. In this embodiment, four first flame holes 282 are provided between each two adjacent pairs of the second flame holes 284, while in other embodiments, the number of the first flame holes 282 is not limited to four. Each pair of the second flame holes 284 is aligned on the same axis in the short axial direction of the burner tray 20. In practice, the second flame holes 284 could also be distributed to two sides of the first flame holes 282 in a staggered manner.

A room 202 is formed between the hole plate 28 and the two vertical plates 26. The splitting member 30 is provided in the room 202, and has a passage 302 and a plurality of perforations 304, wherein the passage 302 extends along the long axial direction of the burner tray 20; the perforations 304 are aligned in the long axial direction of the burner tray 20, and are distributed to two sides of the passage 302 in the short axial direction.

Figure 12:
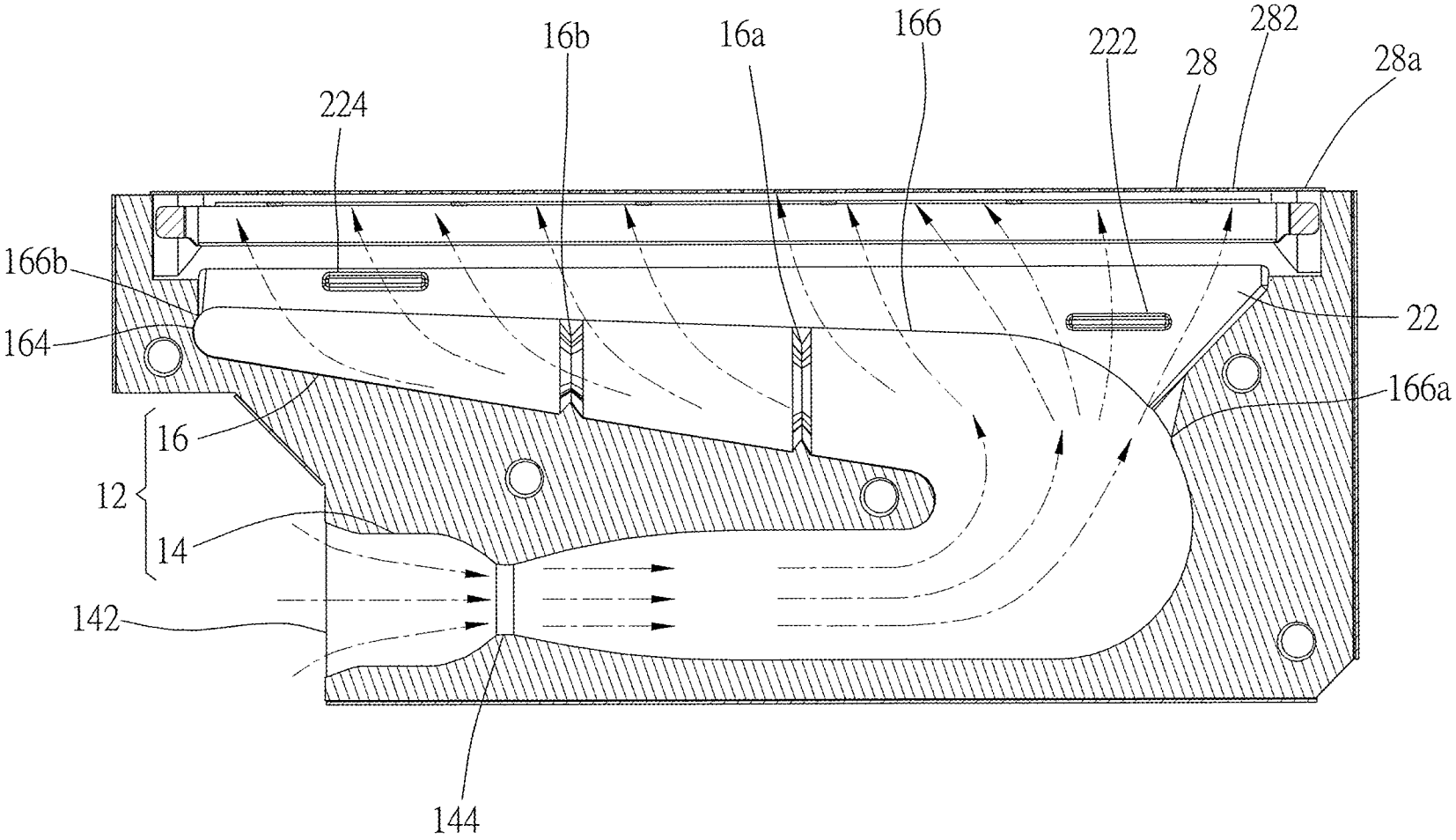
FIG. 12 is a schematic diagram of the first embodiment, showing the flowing direction of the flow.

As shown in FIG. 12, with the aforementioned structures, when the flow of gas and air enters the first pipe section 14 of the pipe 12 through the inlet 142, and then passes through the constricted section 144, the flow rate of the flow is increased because the sectional area of the constricted section 144 passage sectional area tapers off first and then gradually increases. Next, after the flow is delivered to where the second pipe section 16 of the pipe 12 is bent, a part of the flow runs upward and out of the second pipe section 16 through the region between the starting end 166*a* of the outlet 166 and the first reduced section 16*a*. In more details, before running out of the second pipe section 16 through the region near the starting end 166*a* of the outlet 166, the flow runs upward against the wall of the side plate 22, and thus is affected by the protrusion 222 above the starting end 166*a*. Therefore, the part of the flow runs toward the first end 28*a* of the hole plate 28, and sufficient flow is exhausted through the first flame holes 282 and second flame holes 284 between the protrusion 222 and the first end 28*a* of the hole plate 28.

Additionally, after the flow is delivered to where the second pipe section 16 is bent, another part of the flow runs toward the second end 164 of the second pipe section 16. Because the sectional area of the first reduced section 16*a* reduces, the flow running toward the second end 164 is confined by the first reduced section 16*a*. The resistance to the flow before the first reduced section 16*a* is less. As a result, a part of the flow runs upward and is exhausted from the outlet 166 before the first reduced section 16*a*. Accordingly, sufficient flow is exhausted through the first flame holes 282 and second flame holes 284 between the first reduced section 16*a* and the protrusion 222.

Next, a part of the flow passing through the first reduced section 16*a* would run upward and is exhausted from the outlet 166 before the second reduced section 16*b* because the sectional area of the second reduced section 16*b* decreases. Thus, sufficient flow is exhausted through the first flame holes 282 and second flame holes 284 between the first reduced section 16*a* and the second reduced section 16*b*.

In addition, after passing through the second reduced section 16*b* and running toward the outlet 166, the flow is affected by the protrusion 224 between the second reduced section 16*b* and the terminal end 166*b* of the outlet 166, and thus would run toward the second end 28*b* of the hole plate 28. Therefore, sufficient flow is exhausted through the first flame holes 282 and second flame holes 284 between the protrusion 224 and the second end 28*b* of the hole plate 28. The second flame holes 284 are used to adjust partial flame.

Figure 13:
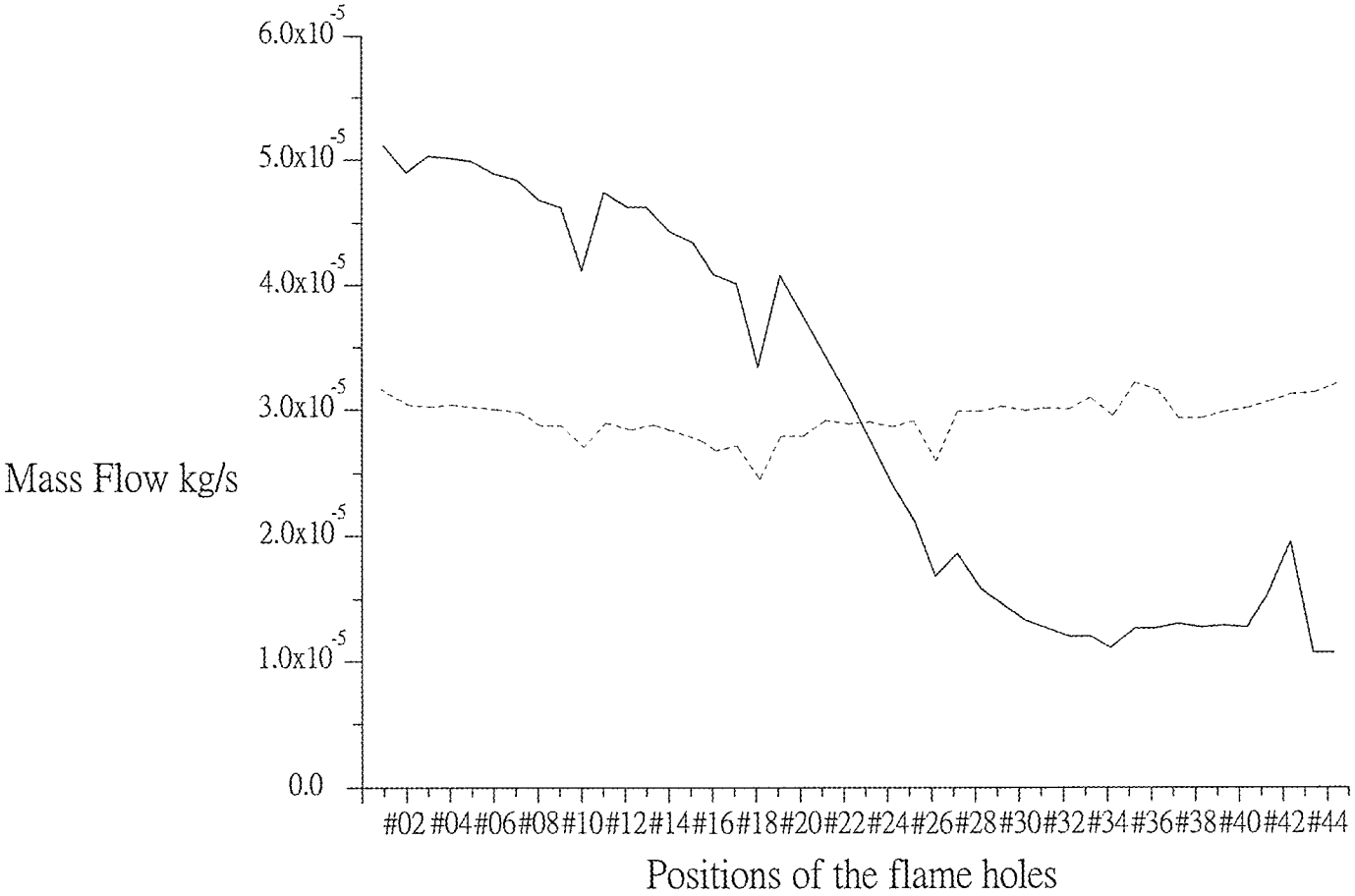
FIG. 13 is a diagram of mass flow corresponding to the positions of the flame holes of the combustor in FIG. 3 and the conventional combustor in FIG. 1.

FIG. 13 is a diagram of mass flow corresponding to the positions of the flame holes 282 of the combustor in this embodiment 3 and the flame holes 3*a* of the conventional combustor 1. The first flame holes 282 are numbered in the order of #01 to #44 from the second end 28*b* to the first end 28*a* of the hole plate 28. It could be seen in FIG. 13 that the distribution of the mass flow corresponding to the first flame holes 282 of the combustor in the embodiment (broken line) is evener than that corresponding to the flame holes 3*a* of the combustor 1 (solid line). Therefore, the combustor of the embodiment generates evener flame, and thus can effectively improve the heating efficiency.

In the abovementioned embodiment, the number of the reduced sections is two. However, the problem of uneven flow exhaust could be improved by the first reduced section only, without the second reduced section. In other embodiments, the second pipe section could have more than two reduced sections. In addition, one of the two pairs of protrusion 222, 224 on the walls of the side plates 22 can be selectively provided depending on the desired combustion efficiency. However, if the desired combustion efficiency has been met, the protrusions protrusion 222, 224 can be omitted. In addition, the splitting member 30 can be omitted practically.

Figure 14:
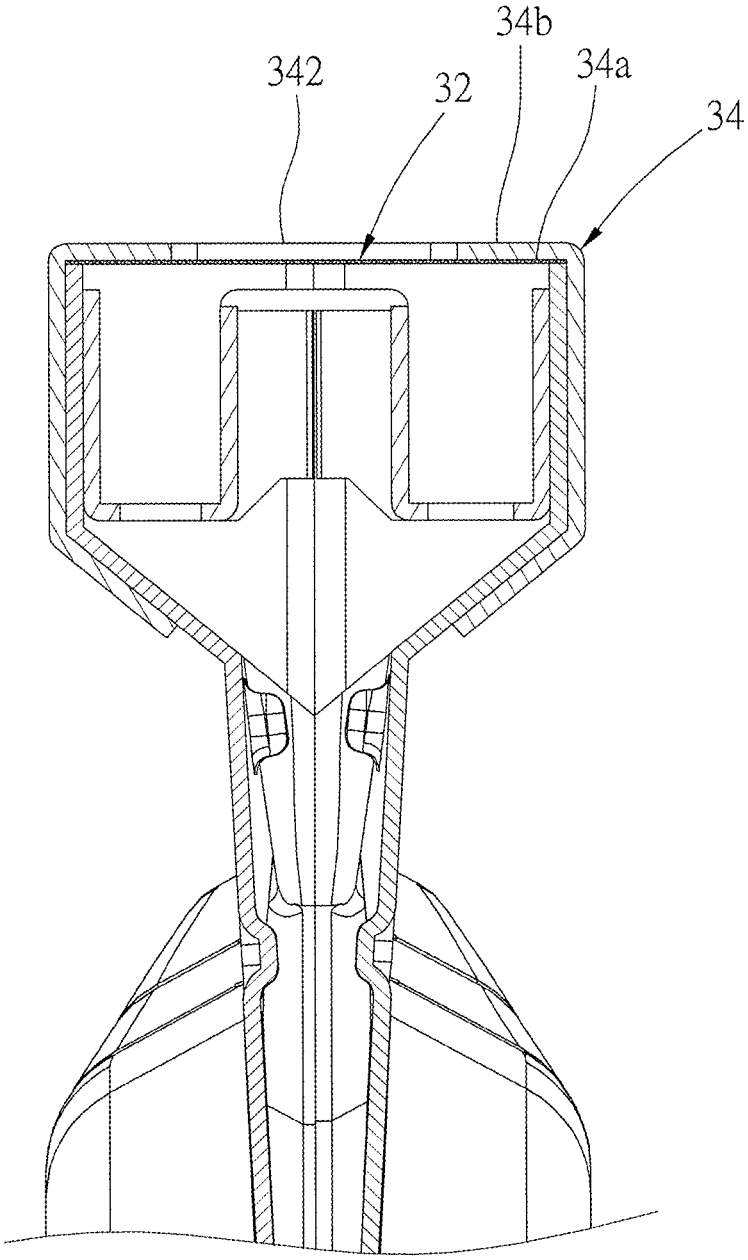
FIG. 14 is a partially exploded view of a second embodiment of the present invention.

FIG. 14 shows the second embodiment which has substantially the same structures as that of the first embodiment. The difference from the first embodiment is that the second embodiment further has a metal net 32 having a plurality of meshes. The burner tray 32 in this embodiment has an inner surface 34*a* and an outer surface 34*b*, wherein the flame holes 342 run through the inner surface 34*a* and the outer surface 34*b*. The metal net 32 is attached to the inner surface 34*a*, and more than one meshes are located in a projection range of each of the flame holes 342. The maximum diameter of each of the meshes of the metal net 32 is less than the minimum width of each of the flame holes 342. The metal net 32 achieves the effect of rectifying the flames emitted from the flame holes 342, which makes the flame more even, and avoids the formation of forked flame.

Figure 15:
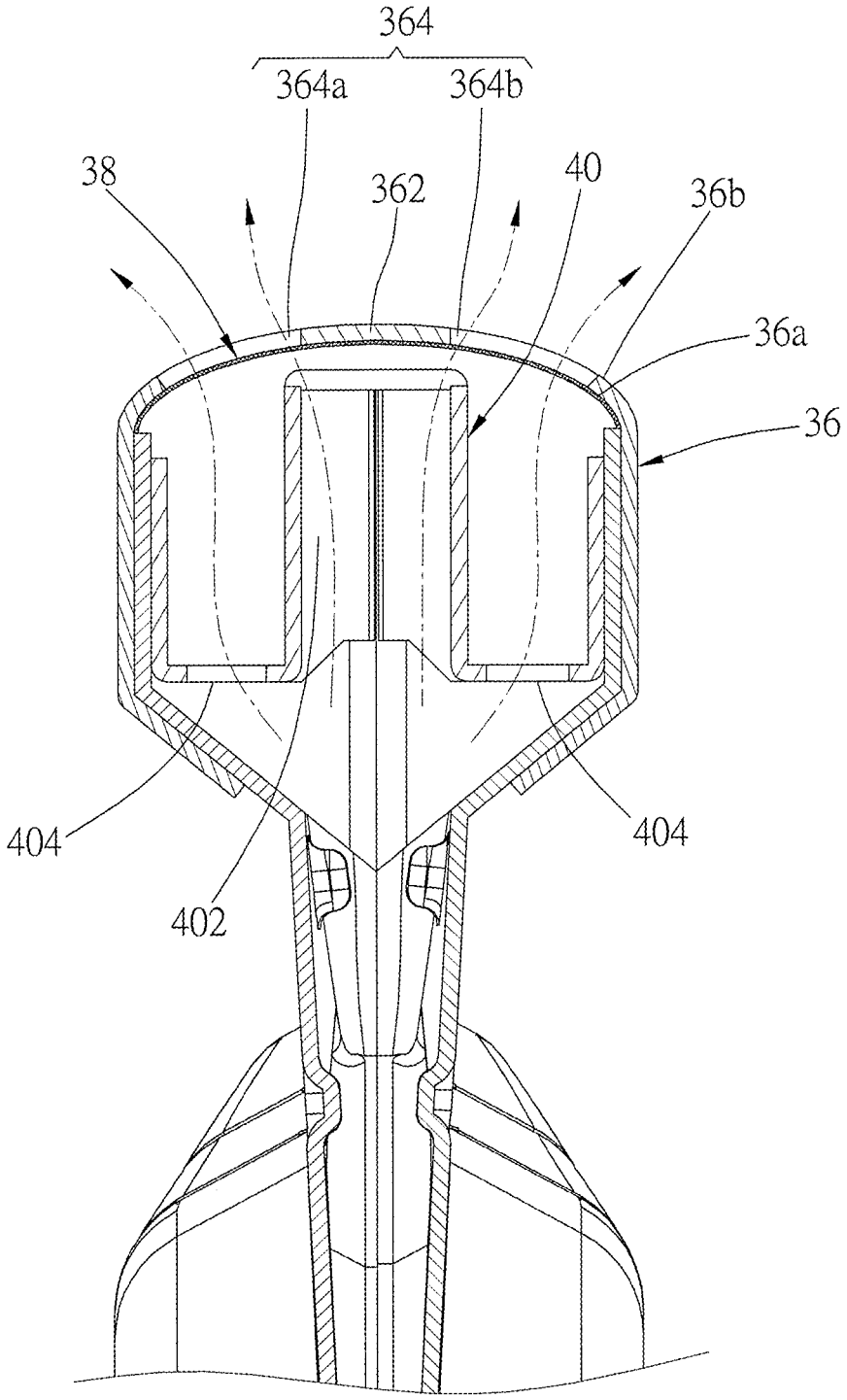
FIG. 15 is a partially exploded view of a third embodiment of the present invention.

FIG. 15 shows the third embodiment which has substantially the same structures as that of the second embodiment. The difference from the second embodiment is that the burner tray 36 in this embodiment has a central block portion 362 extending in the long axial direction of the burner tray 36. The burner tray 36 has a top portion protruding in a direction from the inner surface 36*a* to the outer surface 36*b*. The metal net 38 is attached to the inner surface 36*a*. The flame holes 364 in the third embodiment includes a plurality of first flame holes 364*a* and a plurality of second flame holes 364*b*, wherein the first flame holes 364*a* and the second flame holes 364*b* are respectively distributed to two sides of the central block portion 362 in the short axial direction of the burner tray 36, and are respectively aligned along the long axial direction of the burner tray 36. The passage 402 of the splitting member 40 in this embodiment is provided right under the central block portion 362, while the perforations 404 of the splitting member 40 are respectively provided right under the first flame holes 364*a* and the second flame holes 364*b*. Whereby, the flame can be distributed on both sides of the central block portion 362, and thus the flame emitted from the burner tray 36 can be diffused outwardly in the short axial direction. In practice, if the flame uniformity emitted from the flame holes 364 is not taken into account, the metal net 38 can be omitted. Additionally, the top portion of the burner tray 36 could be flat rather than protruding, as shown in FIG. 14.

In conclusion, with the reduced section in the second pipe section, the flow including gas could be evenly delivered to the burner tray. As a result, after the gas exhausted through the flame holes is ignited, the combustion range would be evener, which enhances the combustion efficiency.

It must be pointed out that the embodiments described above are only some preferred embodiments of the present invention. All equivalent structures which employ the concepts disclosed in this specification and the appended claims should fall within the scope of the present invention.

What is claimed is:

1. A combustor, comprising:

a pipe having a first pipe section and a second pipe section, wherein the first pipe section extends in a predetermined direction; the first pipe section has an inlet at an end thereof, and the second pipe section has a first end and a second end, wherein the first end is connected to another end of the first pipe section; the second pipe section is bent in a direction away from the another end of the first pipe section, and is provided over the first pipe section; the second pipe section has an outlet extending along an axial direction thereof, and a sectional area of the second pipe section is reduced from the first end to the second end; the second pipe section has at least one reduced section, wherein a smallest sectional area in the at least one reduced section is smaller than sectional areas on both sides of the reduced section; and a burner tray connected to the second pipe section, wherein the burner tray is provided over the outlet, and has a plurality of flame holes which communicate with the outlet;

wherein the second pipe section has two opposite inner walls in the predetermined direction at where the second pipe section is bent; one of the inner walls near the inlet has a turning point; the at least one reduced section is located between the turning point and the second end of the second pipe section in the predetermined direction.

2. The combustor of claim 1, wherein the at least one reduced section is formed by stamping.

3. The combustor of claim 1, wherein the second pipe section has a first segment and a second segment, and the at least one reduced section connects the first segment and the second segment; a ratio of the smallest sectional area in the reduced section to a sectional area of a juncture of the reduced section and the first segment is defined as a first ratio, which is between 50% and 65%.

4. The combustor of claim 1, wherein the outlet has a starting end and a terminal end, wherein the starting end is near the first end of the second pipe section, while the terminal end is near the second end of the second pipe section; a distance between the turning point and the terminal end in the predetermined direction is defined as a predetermined distance; a length of the at least one reduced section in the predetermined direction is 2% to 10% of the predetermined distance.

5. The combustor of claim 3, wherein the at least one reduced section comprises a plurality of reduced sections, and the reduced sections comprise a first reduced section and a second reduced section; the first reduced section connects the first segment and the second segment; the second pipe section further has a third segment, wherein the second reduced section connects the second segment and the third segment.

6. The combustor of claim 5, wherein a ratio of the smallest sectional area in the second reduced section to the sectional area of a juncture of the second reduced section and the second segment is defined as a second ratio, which is between 50% and 65%.

7. The combustor of claim 6, wherein the second ratio is less than the first ratio.

8. The combustor of claim 3, wherein the outlet has a starting end and a terminal end, wherein the starting end is near the first end of the second pipe section, while the terminal end is near the second end of the second pipe section; a distance between the turning point and the terminal end in the predetermined direction is defined as a predetermined distance; the first reduced section is provided within a first range between the turning point and the terminal end in the predetermined direction, wherein the first range is between 15% and 30% of the predetermined distance from the turning point.

9. The combustor of claim 5, wherein the outlet has a starting end and a terminal end, wherein the starting end is near the first end of the second pipe section, while the terminal end is near the second end of the second pipe section; a distance between the turning point and the terminal end in the predetermined direction is defined as a predetermined distance; the first reduced section is provided within a first range between the turning point and the terminal end in the predetermined direction; the second reduced section is provided within a second range between the turning point and the terminal end in the predetermined direction; the first range is between 15% and 30% of the predetermined distance from the turning point, while the second range is between 45% and 65% of the predetermined distance from the turning point.

10. The combustor of claim 1, wherein the outlet has a starting end and a terminal end, wherein the starting end is near the first end of the second pipe section, while the terminal end is near the second end of the second pipe section; the burner tray comprises two side plates which are connected to a periphery of the outlet of the second pipe section, wherein the two side plates are provided between the outlet and the flame holes; each of the two side plates has a wall, wherein the two walls face each other, and each of the two walls has a protrusion over the starting end.

11. The combustor of claim 1, wherein the outlet has a starting end and a terminal end, wherein the starting end is near the first end of the second pipe section, while the terminal end is near the second end of the second pipe section; the burner tray comprises two side plates which are connected to a periphery of the outlet of the second pipe section, wherein the two side plates are provided between the outlet and the flame holes; each of the two side plates has a wall, wherein the two walls face each other, and each of the two walls has a protrusion over a region between the reduced section and the terminal end of the outlet.

12. The combustor of claim 1, further comprising a metal net having a plurality of meshes, wherein the burner tray has an inner surface and an outer surface, wherein the flame holes run through the inner surface and the outer surface; the metal net is attached to the inner surface, and more than one meshes are located in a projection range of each of the flame holes.

13. The combustor of claim 1, further comprising a splitting member provided within the burner tray, wherein the burner tray is elongated, and is defined to have a long axial direction and a short axial direction; the burner tray has a central block portion extending in the long axial direction; the flame holes comprises a plurality of first flame holes and a plurality of second flame holes, wherein the first flame holes and the second flame holes are respectively aligned on two sides of the central block portion along the long axial direction; the splitting member has a passage and a plurality of perforations, wherein the passage extends along the long axial direction of the burner tray, and is provided right under the central block portion; the perforations are aligned in the long axial direction, and are distributed to two sides of the passage in the short axial direction.

14. The combustor of claim 13, further comprising a metal net having a plurality of meshes, wherein the burner tray has an inner surface and an outer surface, wherein the flame holes run through the inner surface and the outer surface; the metal net is attached to the inner surface, and more than one meshes are located in a projection range of each of the flame holes.

15. The combustor of claim 13, wherein the burner tray has a top portion protruding in a direction from the inner surface to the outer surface.

16. The combustor of claim 1, wherein the burner tray is elongated, and is defined to have a long axial direction and a short axial direction; the flame holes comprises a plurality of first flame holes and a plurality of second flame holes, wherein the first flame holes are aligned along the long axial direction, and the second flame holes are distributed to two sides of first flame holes in the short axial direction; the second flame holes on each of the two sides of first flame holes are aligned along the long axial direction.

17. The combustor of claim 16, wherein the second flame holes are aligned in the long axial direction of the burner tray in pairs, and at least one of the first flame holes is provided between each two adjacent pairs of the second flame holes; each pair of the second flame holes are aligned on an axis in the short axial direction.

* * * * *